US007923912B2

(12) United States Patent
Won et al.

(10) Patent No.: US 7,923,912 B2
(45) Date of Patent: Apr. 12, 2011

(54) LIGHT-EMITTING ELECTRON EMISSION DEVICE AND DISPLAY DEVICE INCLUDING THE SAME

(75) Inventors: Yong-Gun Won, Suwon-si (KR); Sang-Jin Lee, Suwon-si (KR); Hun-Soo Kim, Suwon-si (KR); Hyeong-Rae Seon, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 636 days.

(21) Appl. No.: 11/857,014

(22) Filed: Sep. 18, 2007

(65) Prior Publication Data

US 2008/0111465 A1 May 15, 2008

(30) Foreign Application Priority Data

Nov. 14, 2006 (KR) ..... 10-2006-0112207

(51) Int. Cl.
*H01J 1/62* (2006.01)

(52) U.S. Cl. ..... 313/495; 313/496; 313/497

(58) Field of Classification Search ..... 313/495–497
See application file for complete search history.

(56) References Cited

U.S. PATENT DOCUMENTS

| | | | | |
|---|---|---|---|---|
| 4,047,073 | A * | 9/1977 | Kishino | 313/497 |
| 5,982,082 | A * | 11/1999 | Janning | 313/336 |
| 7,084,863 | B2 * | 8/2006 | Yoshino | 345/204 |
| 2004/0125062 | A1 * | 7/2004 | Yamamoto et al. | 345/87 |
| 2005/0206299 | A1 * | 9/2005 | Nakamura et al. | 313/495 |
| 2006/0007100 | A1 * | 1/2006 | Hong et al. | 345/102 |
| 2006/0038486 | A1 * | 2/2006 | Onishi | 313/504 |
| 2007/0096623 | A1 * | 5/2007 | Kato et al. | 313/496 |
| 2008/0111469 | A1 * | 5/2008 | Jung et al. | 313/496 |
| 2008/0315748 | A1 * | 12/2008 | Kitada et al. | 313/477 HC |

* cited by examiner

*Primary Examiner* — Nimeshkumar D Patel
*Assistant Examiner* — Mary Ellen Bowman
(74) *Attorney, Agent, or Firm* — Christie, Parker & Hale, LLP

(57) ABSTRACT

A light emission having: a first substrate; a second substrate opposite the first substrate; a sealing member between the first and second substrates and forming a vacuum envelope with the first and second substrates. The device also includes an electron emission unit on the first substrate, the electron emission unit having a plurality of pixel regions, each of the plurality of pixel regions having an independently controlled electron emission; a light emission unit on the second substrate, the light emission unit having a phosphor layer and an anode electrode on the phosphor layer; at least one anode button penetrating the second substrate at a region enclosed by the sealing member and spaced apart from the light emission unit; and a conductive layer on the second substrate and electrically coupling the anode button to the anode electrode.

15 Claims, 5 Drawing Sheets

LIGHT-EMITTING ELECTRON EMISSION DEVICE AND DISPLAY DEVICE INCLUDING THE SAME

CROSS-REFERENCE TO RELATED APPLICATION

This application claims priority to and the benefit of Korean Patent Application No. 10-2006-0112207 filed on Nov. 14, 2006 in the Korean Intellectual Property Office, the entire content of which is incorporated herein by reference.

BACKGROUND OF THE INVENTION

1. Field of the Invention

The present invention relates to a light emission device that emits light using a field emission property, and a display device including the light emission device.

2. Description of the Related Art

A field emitter array FEA electron emission device is provided with cathode and gate electrodes as driving electrodes for controlling electron emission units and emission of electrons thereof. Materials having a low work function or a high aspect ratio are used for an electron emission unit in the FEA electron emission device. For example, carbon-based materials such as carbon nanotubes, graphite, and diamond-like carbon have been developed to be used in an electron emission unit in order for electrons to be easily emitted by an electrical field in a vacuum.

The plurality of electron emission units are arrayed on a substrate to form an electron emission device. The electron emission device is combined with another substrate on which phosphor layers and anode electrodes are formed to form an electron emission display device.

SUMMARY OF THE INVENTION

In exemplary embodiments according to the present invention, a light emission device is provided. The light emission device includes an improved voltage applying structure to prevent a resistance of an anode lead line from increasing and further prevent an arching and leakage current from being generated. A display device including the light emission device is also provided.

In further exemplary embodiments according to the present invention, a light emission device that can independently control light intensities of a plurality of divided regions of a light emission surface is provided. A display device including the light emission device that can enhance the dynamic contrast of the image is also provided.

In one embodiment, a light emission device is provided. The light emission device includes: a first substrate; a second substrate opposite the first substrate; a sealing member between the first and second substrates and forming a vacuum envelope with the first and second substrates. The device also includes: an electron emission unit on the first substrate, the electron emission unit having a plurality of pixel regions, each of the plurality of pixel regions having an independently controlled electron emission; a light emission unit on the second substrate, the light emission unit including a phosphor layer and an anode electrode on the phosphor layer; and at least one anode button penetrating the second substrate at a region enclosed by the sealing member and spaced apart from the light emission unit. The device also includes: a conductive layer on the second substrate and electrically coupling the anode button to the anode electrode.

In some embodiments, an adhesive layer including glass frit is between the anode button and the second substrate.

In some embodiments, the anode button is sized to satisfy 8-12 W/mm$^2$. In some embodiments, the anode button includes an iron-nickel-cobalt alloy.

In some embodiments, the conductive layer has a surface resistance equal to or less than 300 Ω/sq and includes a graphite layer or a metal layer.

In some embodiments, a gap between the first substrate and the second substrate is within a range of 5-20 mm; and the light emission unit further includes a voltage applying unit configured to apply a voltage within a range of 10-15 kV to the anode electrode.

In some embodiments, the electron emission unit includes: a first electrode; a second electrode crossing the first electrode, the first electrode and the second having an insulation layer between the first electrode and the second electrode; and an electron emission portion electrically coupled to one of the first electrode or the second electrode.

In one embodiment, a display device is provided. The display device includes: a display panel assembly having a first plurality of pixels arranged in rows and columns; and a backlight unit having a second plurality of pixels arranged in rows and columns for emitting light toward the display panel assembly, a number of the pixels of the backlight unit being less than a number of pixels of the display panel assembly. The backlight unit includes: a first substrate; a second substrate opposite the first substrate; a sealing member between the first and second substrates and forming a vacuum envelope with the first and second substrates. The electron emission unit includes: scan electrodes; data electrodes; and electron emission portions electrically coupled to the scan electrodes or the data electrodes; a light emission unit on the second substrate, the light emission unit includes a phosphor layer and an anode electrode on the phosphor layer; at least one anode button penetrating the second substrate at a region enclosed by the sealing member and spaced apart from the light emission unit; and a conductive layer on the second substrate and electrically coupling the anode button to the anode electrode.

In some embodiments, an adhesive layer of glass frit is interposed between the anode button and the second substrate. In some embodiments, the anode button is sized to satisfy 8-12 W/mm$^2$.

In some embodiments, the anode button includes an iron-nickel-cobalt alloy. In some embodiments, the conductive layer has a surface resistance less than 300 Ω/sq and is a graphite layer or a metal layer.

In some embodiments, a gap between the first substrate and the second substrate is within a range of 5-20 mm; and the light emission unit further includes: a voltage applying unit configured to apply a voltage within a range of 10-15 kV to the anode electrode.

In some embodiments, a number of the second plurality of pixels arranged in each row of the backlight unit is 2 to 99 pixels and a number of the first plurality of pixels arranged in each column of the backlight unit is 2 to 99 pixels.

In some embodiments, each of the second plurality of pixels emits light in response to a highest gray value among one or more of corresponding ones of the first plurality of pixels.

DETAILED DESCRIPTION OF THE INVENTION

Figure 1:
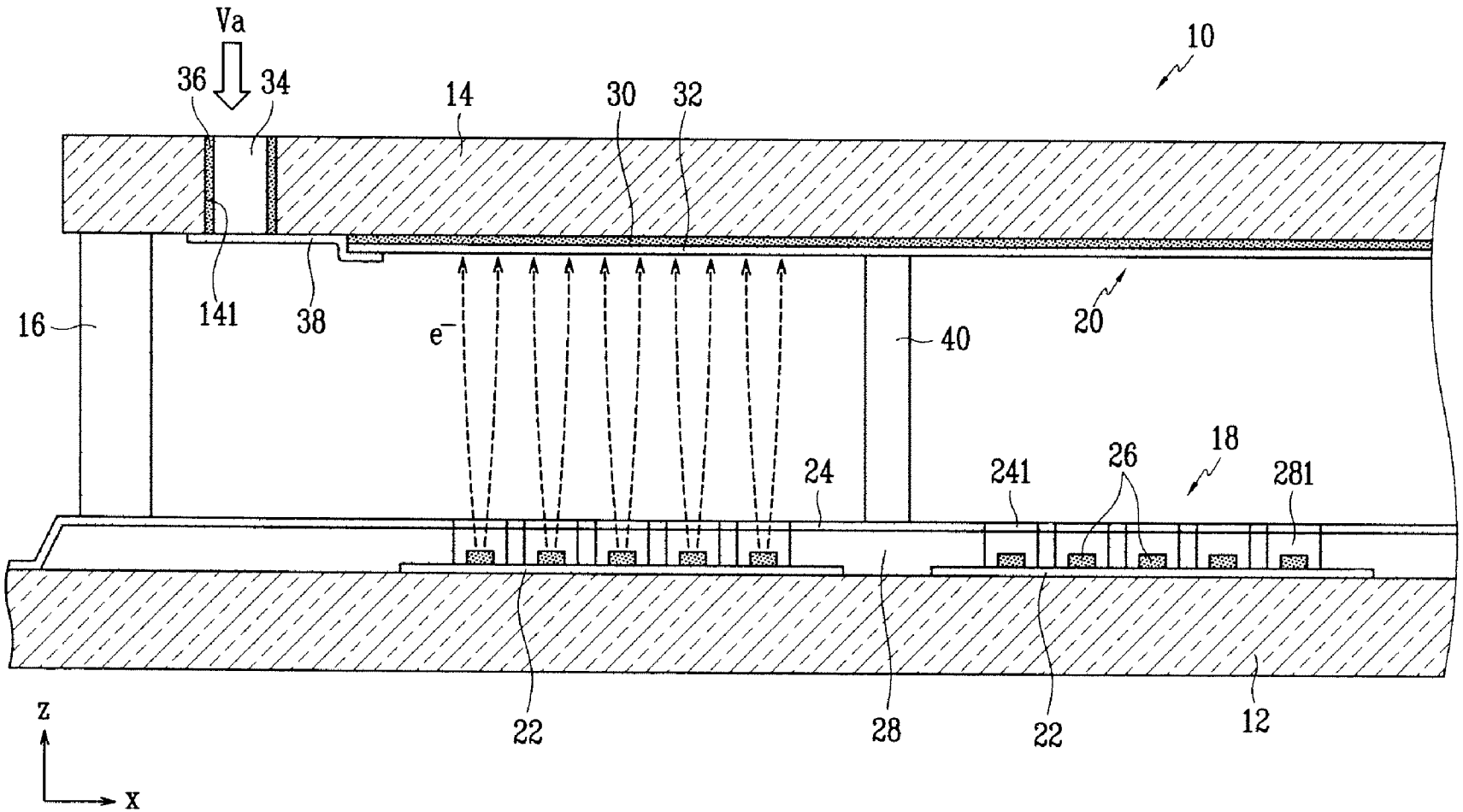
FIG. 1 is a partial sectional view of a light emission device according to an exemplary embodiment of the present invention.

With reference to the accompanying drawings, embodiments of the present invention will be described in order for those skilled in the art to be able to implement it. As those skilled in the art would realize, the described embodiments may be modified in various different ways, all without departing from the spirit or scope of the present invention. Wherever possible, the same reference numbers will be used throughout the drawings to refer to the same or like parts.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another element, component, region, layer, or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," or "includes" and/or "including", when used in this specification, specify the presence of stated features, regions, integers, steps, operations, elements and/or components, but do not preclude the presence or addition of one or more other features, regions, integers, steps, operations, elements, components and/or groups thereof.

Spatially relative terms, such as "beneath", "below", "lower", "above", "upper", "over", and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein are interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to perspective views and cross-sectional views that are schematic illustrations of idealized embodiments of the present invention. As such, variations from the shapes of the illustrations as a result, for example, of manufacturing techniques and/or tolerances, are to be expected. Thus, embodiments should not be construed as being limited to the particular shapes of regions illustrated herein but are to include variations in shapes that result, for example, from manufacturing. As an example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

In an embodiment of the present invention, light emission device includes any device from which a light is recognized to be emitted when it is seen from outside. Therefore, all display devices that display symbols, letters, numbers and image and then deliver information are also included in the light emission device. Since the light emission device can use a self-emissive light source as well as an external light source, it also includes a device in which an external light is reflected and used.

Figure 2:
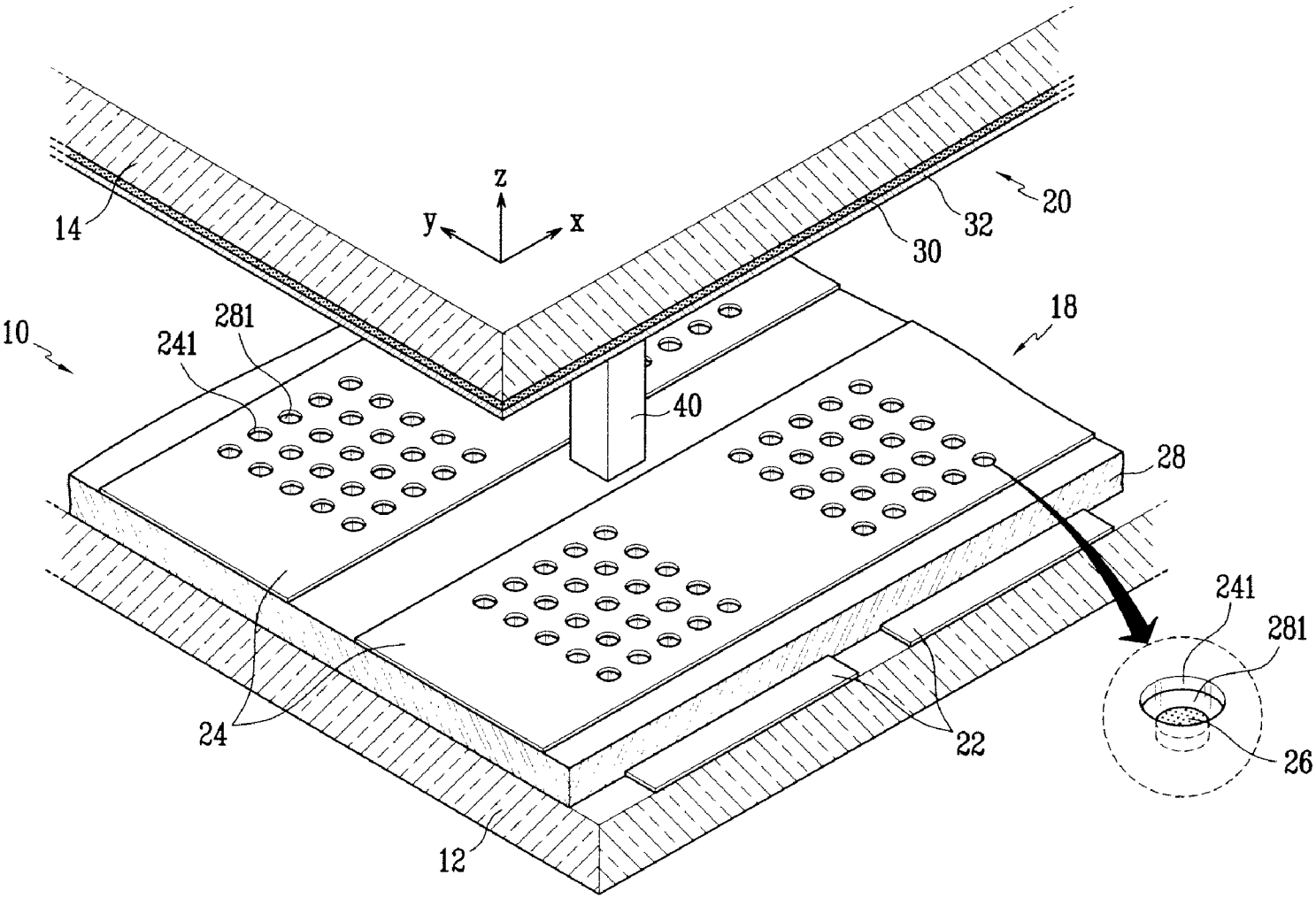
FIG. 2 is a partial exploded perspective view of the light emission device of FIG. 1.

FIGS. 1 and 2 show a light emission device according to an exemplary embodiment of the present invention.

Referring to FIGS. 1 and 2, a light emission device 10 according to an embodiment includes first and second substrates 12 and 14 facing each other at an interval (e.g., a predetermined interval). A sealing member 16 is provided at the peripheries of the first and second substrates 12 and 14 to seal them together and thus form a sealed envelope. The interior of the sealed envelope is evacuated to a degree of vacuum of about $10^{-6}$ torr.

Each of the first and second substrates 12 and 14 has a display area for emitting visible light and a non-display area surrounding the display area within a region surrounded by the sealing member 16. An electron emission unit 18 for emitting electrons is provided on the first substrate 12 at the display area and a light emission unit 20 for emitting the visible light is provided on the second substrate 14 at the display area.

The electron emission unit 18 includes first electrodes 22 and second electrodes 24 and electron emission portions 26 that are electrically connected to the first electrodes 22 or the second electrodes 24. The first electrodes 22 are insulated from the second electrodes 24.

When the electron emission portions 26 are located on the first electrodes 22, the first electrodes 22 function as cathode electrodes for applying a current to the electron emission portions 26 and the second electrodes 24 function as gate electrodes for inducing the electron emission by forming the electric field around the electrode emission regions 32 according to a voltage difference between the cathode and gate electrodes. On the contrary, when the electron emission portions 26 are located on the second electrodes 24, the second electrodes 24 function as the cathode electrodes and the first electrodes 22 function as the gate electrodes.

The first electrodes 22 are arranged in a stripe pattern on the first substrate 12 and extending in a first direction and the second electrodes 24 are arranged in a stripe pattern and extending in a second direction crossing the first electrodes 22. An insulation layer 28 is interposed between the first electrodes 22 and the second electrodes 24. When the light emission device 10 operates, one of the first and second electrodes 22 and 24 may function as a scan electrode for receiving a scan drive voltage and the other may serve as a data electrode for receiving a data drive voltage.

Openings 281 and 241 corresponding to the respective electron emission portions 26 are formed in the insulation layer 28 and the second electrodes 24, respectively, at each crossed region of the first and second electrodes 22 and 24 to partly expose the surface of the first electrodes 22 and the electron emission portions 26, which are formed on the exposed portions of the first electrodes 22. However, the positions of the electron emission portions 26 are not limited to the positions in this embodiment.

The electron emission portions 26 are formed of a material that emits electrons when an electric field is applied thereto under a vacuum atmosphere, such as a carbon-based material or a nanometer-sized material. The electron emission portions 26 can be formed of carbon nanotubes, graphite, graphite nanofibers, diamonds, diamond-like carbon, $C_{60}$, silicon nanowires or a combination thereof. In some embodiments, the electron emission units can have a tip structure formed of a Mo-based or Si-based material.

One crossed region of the first and second electrodes 22 and 24 may correspond to one pixel region of the light emission device 10. In some embodiments, two or more crossed regions of the first and second electrodes 22 and 24 may correspond to one pixel region of the light emission device 10. In this embodiment, two or more first electrodes 22 and/or two or more second electrodes 24 that are placed in one pixel region are electrically connected to each other to receive a common drive voltage.

The light emission unit 20 includes a phosphor layer 30 and an anode electrode 32 formed on the phosphor layer 30.

The phosphor layer 30 may be a white phosphor layer or a combination of red, green and blue phosphor layers. The white phosphor layer may be formed on the entire display area of the second substrate 14 or patterned to have a plurality of sections corresponding to the respective pixel regions. The combination of the red, green and blue phosphor layers may correspond to one pixel region. In such embodiments, each of the pixel regions may have a corresponding combination of red, green and blue phosphor layers.

FIGS. 1 and 2 show an example where the white phosphor layer is formed on the entire display area of the second substrate 14.

The anode electrode 32 covering the phosphor layer 30 may be formed of metal such as Al. The anode electrode 32 is an acceleration electrode that receives a high voltage to maintain the phosphor layer 30 at a high electric potential state. The anode electrode 32 enhances the luminance by reflecting the visible light, which is emitted from the phosphor layer 30 to the first substrate 12, toward the second substrate 14.

Figure 3:
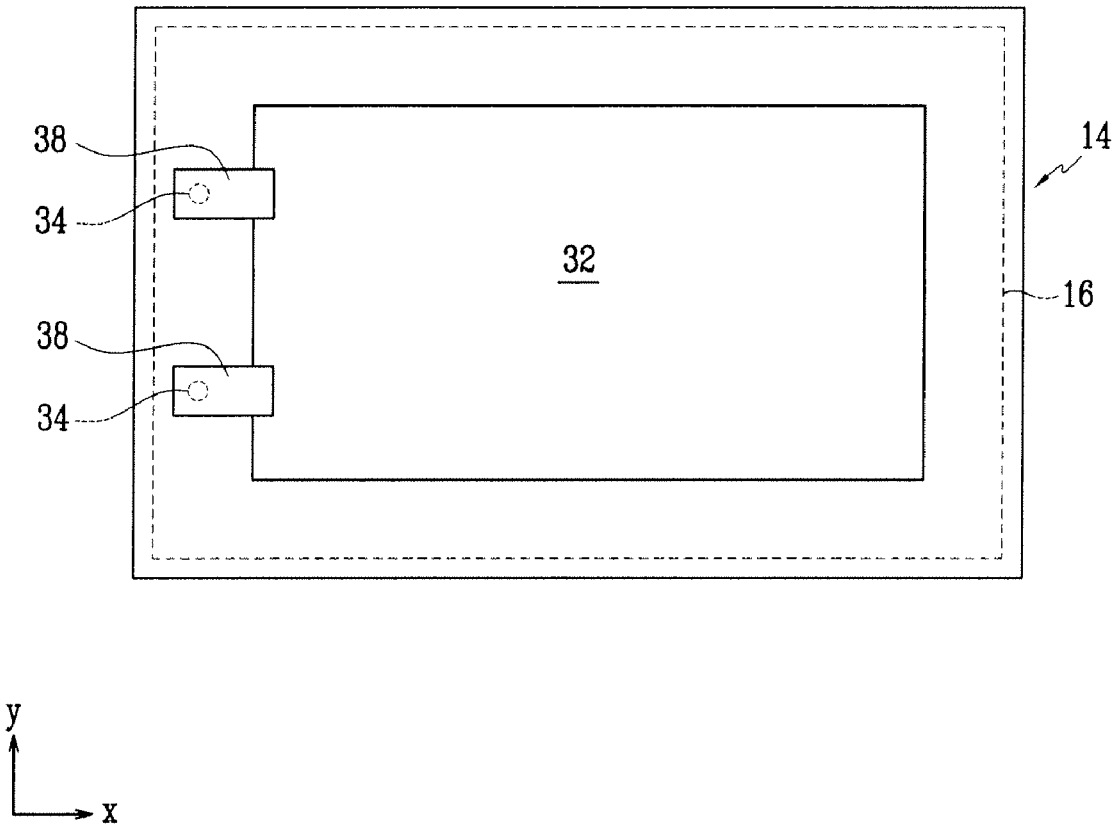
FIG. 3 is a partial bottom view of a second substrate of the light emission device of FIGS. 1 and 2.

FIG. 3 is a partial bottom view of a second substrate of the light emission device of FIGS. 1 and 2.

Referring to FIGS. 1, 2 and 3, the anode electrode 32 receives an anode voltage Va through anode buttons 34 that penetrate the second substrate 14 at a non-display area located within a region surrounded by the sealing member 16.

That is, the second substrate 14 has openings 141 at the non-display area enclosed by the sealing member 16. The anode buttons 34 are filled in the openings 141 and fixed in the second substrate 14. At this point, in order to provide air tightness between the second substrate 14 and the anode buttons 34, adhesive layers 36 may be formed on respective outer circumferential surfaces of the anode buttons 34. Since the anode buttons 34 are used, embodiment of the light emission device can prevent a resistance of an anode lead line from increasing and further prevent an arching and leakage current, In comparison with the embodiment of the present invention, in a typical field emission type light emission device, an anode lead line connected to the anode electrode leads out of a sealing member. An anode voltage is applied through the anode lead line. The anode lead line is generally formed of a transparent conductive layer such as indium tin oxide (ITO).

However, in the above device, as the intensity of the voltage applied to the anode electrode increases, the leakage current may increase. Furthermore, due to a voltage difference between the anode lead line and the sealing member that is formed of a nonconductive material, an arcing may be generated at a contact portion between the anode lead line and the sealing member. Furthermore, when the sealing member formed of glass frit-based material is baked at a temperature above 300° C., a portion of the anode lead line, which contacts the sealing member, varies in its property to increase the resistance.

On the contrary, the above problems may be solved by using the anode buttons 34 in the embodiment of present invention. Conductive layers 38 for connecting bottom surfaces of the respective anode buttons 34 to the anode electrode 32 are formed on an inner surface of the second substrate 14. Top surfaces of the respective anode buttons 34 are electrically connected to a voltage applying unit (not shown) so as to apply the voltage to the anode electrode 32 via the anode buttons 34 and the conductive layers 38 from outside of the second substrate 14.

The anode buttons 34 are formed of metal having a relatively low resistivity and a thermal expansion coefficient similar to that of the second substrate 14. For example, the anode button 34 may be formed of an alloy including Fe of 55 w %, Ni of 29 w %, and Co of 17 w %.

In this case, the thermal expansion coefficient of the second substrate 14 is about $81\times10^{-7}$/° C. and the thermal expansion coefficient of the anode buttons 34 is about $55\times10^{-7}$/° C. The thermal expansion coefficient of the adhesive layer 36 formed of glass frits may be about $71\times10^{-7}$/° C. Therefore, even when high thermal baking processes are performed several times, the deformation and the crack generation which is caused by the difference between the thermal expansion coefficients can be reduced or prevented.

As the size of the anode button 34 is reduced, it becomes easier to install the anode button 34 in the second substrate 14. However, when the anode button 34 is too small, the resistance thereof increases when the high voltage is applied to the small sized anode button 34. Therefore, a number of the anode buttons 34 may be installed as the magnitude of the anode voltage and the area of the light emission surface are increased.

In cases where a voltage of 10-15 kV is applied to the anode electrode 32, the anode button 34 is sized to satisfy the condition of 8-12 W/mm$^2$. When this condition is satisfied, the anode button 34 can be easily installed in the second substrate 14 and the heat generation problem due to the increase of the resistance can be reduced or prevented.

FIG. 3 shows an embodiment wherein two anode buttons 34 are positioned at one side of the second substrate 14 near the periphery.

The conductive layers 38 may be graphite layers or metal layers having a surface resistance lower than 300 Ω/sq. Each of the conductive layers 38 may be formed to have a width greater than a diameter of the corresponding anode button 34.

In the above-described anode voltage applying structure, the generation of arcing may be prevented and the connection of the outer voltage applying unit to the anode electrode 32 may be easily realized. Furthermore, since the second substrate 14 formed of glass-based material can directly contact the sealing member 16 without using an intermediate medium, the vacuum release may be reduced or minimized. Furthermore, even when the high voltage above 10 kV is applied to the anode electrode 32, in some embodiments no leakage current is generated.

Referring back to FIG. 1, spacers 40 are located between the first and second substrates 12 and 14 for uniformly maintaining a gap between the first and second substrates 12 and 14 against the outer force. The gap between the first and second substrates 12 and 14 is about 5-20 mm and the spacers 40 are designed to have a height corresponding to the gap between the first and second substrates 12 and 14.

The above-described light emission device 10 is driven by applying drive voltages to the first and second electrodes 22 and 24 and applying a predetermined positive DC voltage above 10 kV, and, in some embodiments, within a range of 10-15 kV.

Then, an electric field is formed around the electron emission portions 26 at pixel regions where a voltage difference between the first and second electrodes 22 and 24 is higher than a threshold value, thereby emitting electrons from the electron emission portions 26. The emitted electrons are accelerated by the high voltage applied to the anode electrode 32 to collide with the corresponding phosphor layer 30, thereby exciting the phosphor layer 30. A light emission intensity of the phosphor layer 30 at each pixel corresponds to an electron emission amount of the corresponding pixel. In one exemplary embodiment of the present invention, the inventive light emission device 10 realizes a luminance above 10,000 cd/m$^2$ at a central portion of the display area.

A process for forming the anode button and conductive layer on the second substrate of the light emission device will now be described with reference to FIGS. 4A, 4B and 4C.

Figure 4A:
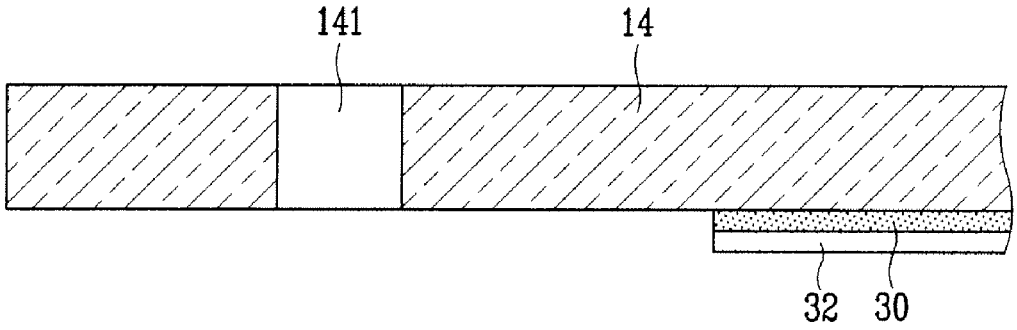
FIGS. 4A, 4B and 4C are partial sectional views illustrating a process for forming an anode button and a conductive layer on a second substrate of the light emission device of FIGS. 1, 2 and 3.

Referring to FIG. 4A, after the phosphor layer 30 and the anode electrode 32 are formed on the display area of the second substrate 14, an opening 141 is formed on the non-display area of the second substrate 14.

Figure 4B:
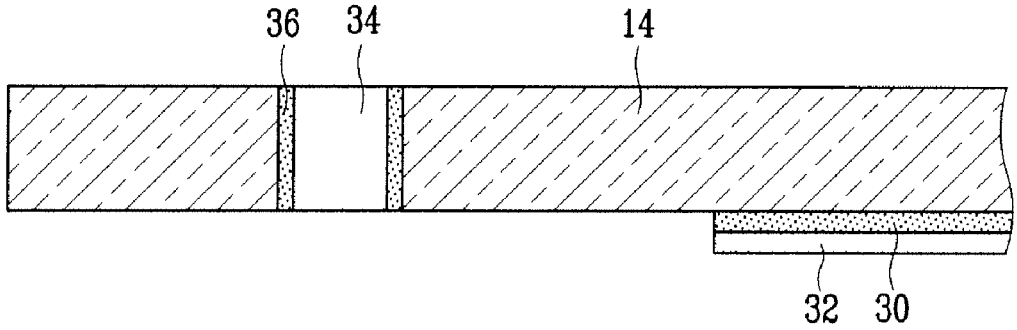

Referring to FIG. 4B, glass frit is coated on an outer circumferential surface of the anode button 34 and the anode button 34 is fitted in the opening 141 of the second substrate 14. Then, the glass frit is baked at 430° C. and then cooled to a room temperature. Then, the adhesive layer 36 formed by the molted glass frit is formed between the second substrate 14 and the anode button 34, thereby fixing the anode button 34 in the second substrate 14.

Figure 4C:
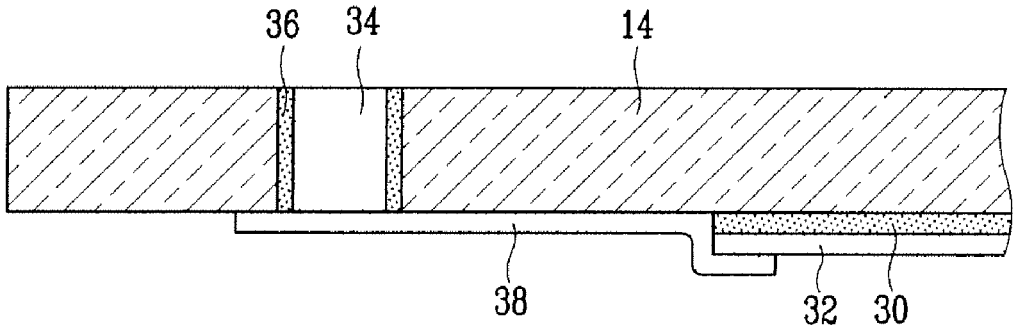

Referring to FIG. 4C, the conductive layer 38 having a width and length (e.g., a predetermined width and length) is formed such that one end thereof covers the anode button 34 and the other end thereof contacts the anode electrode 32. The conductive layer 38 is formed by screen printing, drying and baking paste mixture containing graphite. In some embodiments, the conductive layer 38 may be formed by depositing or sputtering metal.

Figure 5:
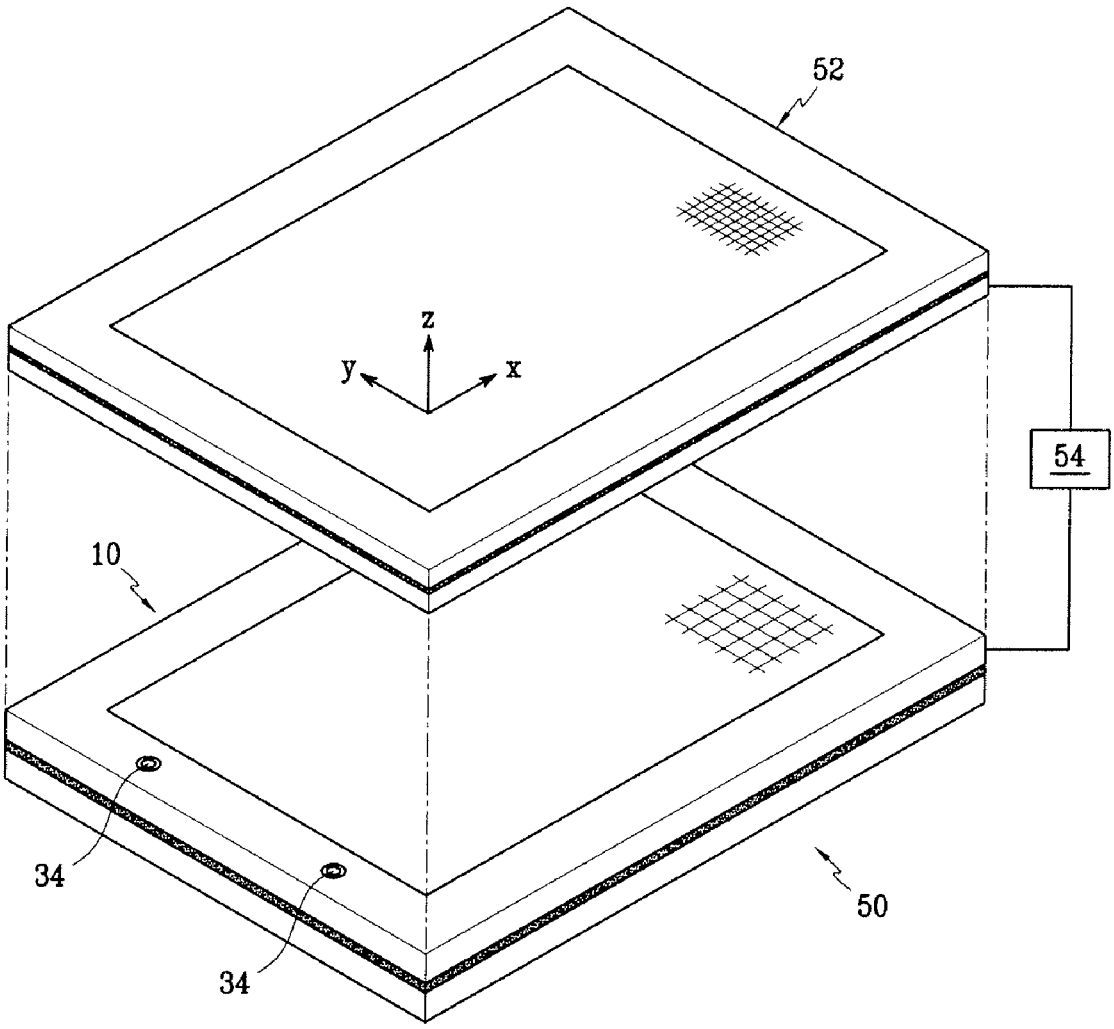
FIG. 5 is a partial exploded perspective view of a display device according to an exemplary embodiment of the present invention.

FIG. 5 is an exploded perspective view of a display device including a light emission device according to an embodiment of the present invention. FIG. 5 illustrates a liquid crystal display 50 as an example of a display device.

The conventional backlight units are required to maintain a predetermined brightness when the liquid crystal display is driven. However, it is difficult to improve the display quality of the liquid crystal display to a sufficient level. For example, when the liquid crystal panel assembly intends to display an image having a high luminance portion and a low luminance portion in response to an image signal, it will be possible to realize an image having a more improved dynamic contrast if the backlight unit can emit lights having different intensities to the selected high and low luminance portions. However, since the conventional backlight units cannot achieve the above function, the liquid crystal display has a limitation in improving the dynamic contrast of the image.

On the contrary, according to an embodiment of the present invention, the above problems may be solved by using the above light emission device that can realize a dimmed driving.

Referring to FIG. 5, in an embodiment, a liquid crystal display 50 includes a display panel assembly, for example, a liquid crystal panel assembly 52 having a plurality of pixels arranged in rows and columns and a light emission device 10 (hereinafter referred to as a "backlight unit") for emitting light toward the liquid crystal panel assembly 52. If required, an optical member such as a diffuser plate may be interposed between the liquid crystal panel assembly 52 and the backlight unit 10.

In this embodiment, the number of pixels of the backlight unit 10 is less than that of the liquid crystal panel assembly 52 so that one pixel of the backlight unit 10 corresponds to two or more pixels of the liquid crystal panel assembly 52. Each pixel of the backlight unit 10 emits light in response to the highest gray value among the corresponding pixels of the liquid crystal panel assembly 52. In one embodiment, the backlight unit 10 can represent gray levels corresponding to 2-8 bits of data.

For convenience, the pixels of the liquid crystal panel assembly 52 will be referred to as first pixels and the pixels of the backlight unit 10 will be referred to as second pixels. In addition, a plurality of first pixels corresponding to one second pixel will be referred to as a first pixel group.

In order to drive the backlight unit, a signal control unit 54 for controlling the liquid crystal panel assembly 52 detects a highest gray value among the first pixels of the first pixel group, calculates a gray value required for the light emission of the second pixel according to the detected gray value, converts the calculated gray value into digital data, and generates a driving signal of the backlight unit 10 using the digital data. Therefore, when an image is displayed by the first pixel group, the corresponding second pixel of the backlight unit 10 is synchronized with the first pixel group to emit the light with a gray value (e.g., a predetermined gray value).

The rows are defined in a horizontal direction (the x-axis in FIG. 5) of the screen formed by the liquid crystal panel assembly 52, and the columns are defined in a vertical direction (the y-axis in FIG. 5) of the screen formed by the liquid crystal panel assembly 52.

The number of pixels arranged in each row of the liquid crystal panel assembly 52 may be more than 240 and the number of pixels arranged in each line of the liquid crystal panel assembly 52 may also be more than 240. In addition, the number of pixels arranged in each row of the backlight unit 10 may be 2-99 and the number of pixels arranged in each line of the backlight unit 10 may also be 2-99. In one embodiment, when the number of the pixels in each of the row and column of the backlight unit 10 is higher than 99, it may be complicated to drive the backlight unit and the cost for manufacturing the driving circuit may increase. In other embodiments, the back light unit may have more than 99 pixels in each row and/or each column.

As described above, in one embodiment, the backlight unit 10 is an emissive display panel having 2×2 through 99×99 resolutions. In addition, the light emission intensities of the pixels of the backlight unit 10 are independently controlled to emit a proper intensity of the light to each second pixel group of the liquid crystal panel assembly 52. As a result, the display device 50 can enhance the dynamic contrast ratio of the screen, thereby improving the display quality.

Although exemplary embodiments of the present invention have been shown and described, it will be appreciated by those skilled in the art that changes may be made in this embodiment without departing from the principles and spirit of the invention, the scope of which is defined in the claims and their equivalents.

What is claimed is:

1. A light emission device comprising:
- a first substrate;
- a second substrate opposite the first substrate;
- a sealing member between the first and second substrates and forming a vacuum envelope with the first and second substrates;
- an electron emission unit on the first substrate, the electron emission unit having a plurality of pixel regions, each of the plurality of pixel regions having an independently controlled electron emission;
- a light emission unit on the second substrate, the light emission unit comprising a phosphor layer and an anode electrode on the phosphor layer;
- at least one anode button penetrating the second substrate at a region enclosed by the sealing member, sized to have a power density between 8 and 12 W/mm$^2$ and spaced apart from the light emission unit; and
- a conductive layer on the second substrate and electrically coupling the anode button to the anode electrode.

2. The device of claim 1, wherein an adhesive layer comprising glass frit is between the anode button and the second substrate.

3. The device of claim 1, wherein the anode button comprises an iron-nickel-cobalt alloy.

4. The device of claim 1, wherein the conductive layer has a surface resistance equal to or less than 300 Ω/sq and comprises a graphite layer or a metal layer.

5. The device of claim 1, wherein:
- a gap between the first substrate and the second substrate is within a range of 5-20 mm; and
- the light emission unit further comprises a voltage applying unit configured to apply a voltage within a range of 10-15 kV to the anode electrode.

6. The device of claim 5, wherein the electron emission unit comprises:
- a first electrode;
- a second electrode crossing the first electrode, the first electrode and the second having an insulating layer between the first electrode and the second electrode; and
- an electron emission portion electrically coupled to one of the first electrode or the second electrode.

7. A display device comprising:
- a display panel assembly having a first plurality of pixels arranged in rows and columns; and
- a backlight unit having a second plurality of pixels arranged in rows and columns for emitting light toward the display panel assembly, a number of the pixels of the backlight unit being less than a number of pixels of the display panel assembly, wherein, the backlight unit comprises:
  - a first substrate;
  - a second substrate opposite the first substrate;
  - a sealing member between the first and second substrates and forming a vacuum envelope with the first and second substrates;
  - an electron emission unit on the first substrate, the electron emission unit comprising:
    - scan electrodes;
    - data electrodes; and
    - electron emission portions electrically coupled to the scan electrodes or the data electrodes;
  - a light emission unit on the second substrate, the light emission unit comprising a phosphor layer and an anode electrode on the phosphor layer;
  - at least one anode button penetrating the second substrate at a region enclosed by the sealing member, sized to have a power density between 8 and 12 W/mm$^2$, and spaced apart from the light emission unit; and
  - a conductive layer on the second substrate and electrically coupling the anode button to the anode electrode.

8. The device of claim 7, wherein an adhesive layer of glass frit is interposed between the anode button and the second substrate.

9. The device of claim 7, wherein the anode button comprises an iron-nickel-cobalt alloy.

10. The device of claim 7, wherein the conductive layer has a surface resistance less than 300 Ω/sq and is a graphite layer or a metal layer.

11. The device of claim 7, wherein:
- a gap between the first substrate and the second substrate is within a range of 5-20 mm; and
- the light emission unit further comprises a voltage applying unit configured to apply a voltage within a range of 10-15 kV to the anode electrode.

12. The device of claim 7, wherein each of the rows of the second plurality of pixels of the backlight unit has between 2 and 99 pixels and each of the columns of the second plurality of pixels of the backlight unit has between 2 and 99 pixels.

13. The device of claim 12, wherein each of the second plurality of pixels emits light in response to a highest gray value among one or more of corresponding ones of the first plurality of pixels.

14. The device of claim 1, wherein the conductive layer on the second substrate covers entirely the portion of the anode button within the vacuum envelope.

15. The device of claim 7, wherein the conductive layer on the second substrate covers entirely the portion of the anode button within the vacuum envelope.

* * * * *